United States Patent [19]

Jones

[11] Patent Number: 4,921,192

[45] Date of Patent: May 1, 1990

[54] GOLF BAG HAVING INTEGRAL SUPPORT STAND

[75] Inventor: George H. Jones, Lake Oswego, Oreg.

[73] Assignee: Jones Sports Co., Portland, Oreg.

[21] Appl. No.: 374,759

[22] Filed: Jul. 3, 1989

[51] Int. Cl.[5] ..... A63B 55/00

[52] U.S. Cl. ..... 248/96

[58] Field of Search ..... 248/96, 95, 97, 98, 248/143, 171; 206/315.2, 315.3

[56] References Cited

U.S. PATENT DOCUMENTS

| | | | |
|---|---|---|---|
| 1,686,774 | 10/1928 | Sperry | 248/96 |
| 1,752,114 | 3/1930 | Shaw | 248/96 |
| 2,036,791 | 4/1936 | Bretschger | 248/143 |
| 4,620,682 | 11/1986 | Yim | 248/96 |
| 4,676,464 | 6/1987 | Reimers | 248/96 |

FOREIGN PATENT DOCUMENTS

| | | | |
|---|---|---|---|
| 25576 | of 1913 | United Kingdom | 248/96 |

*Primary Examiner*—Alvin C. Chin-Shue

*Attorney, Agent, or Firm*—Chernoff, Vilhauer, McClung & Stenzel

[57] ABSTRACT

A golf bag has legs attached to its side which are movable between a retracted position against the side of the bag and an extended position where they act in cooperation with the base of the bag to support the bag at an acute angle with respect to the vertical so that golf clubs carried in the bag are readily accessible. The legs are movable to their extended position by a rod which extends from the legs to the bottom of the bag. A portion of the base of the bag adjacent to the actuation rod is relieved thereby permitting the bag to be placed vertically on its base without interference from the rodo while still allowing the rod to be moved by placing it on the ground and pushing the bag downwardly.

4 Claims, 2 Drawing Sheets

GOLF BAG HAVING INTEGRAL SUPPORT STAND

BACKGROUND AND SUMMARY OF THE INVENTION

This invention relates to golf bags and in particular to golf bags having integral support stands.

When a golf bag is carried by a golfer or a caddy it is desirable that it include a stand which will support it in a generally upright position where the golf clubs are readily visible for selection and can easily be removed and reinserted into the bag. This function has been accommodated in the past by providing legs that are movable between a retracted position where they rest against the side of the bag, and an extended position where they extend outwardly from the bag. Thus the legs do not interfere with carrying the bag when they are retracted, and yet act in cooperation with the base of the bag to support it when they are extended.

Several methods have been used to move the legs between their retracted and extended positions. One method, which is used in a bag sold by Sun Mountain Sports of Missoula, Montana, connects the legs to the shoulder strap which is used to carry the bag. The legs are moved to their extended position by pulling on the shoulder strap and are moved back to their retracted position by a retraction spring when the bag is lifted off of the ground. Due to its complexity, this mechanism is expensive to manufacture and is easily damaged. In addition, this mechanism is awkward to use, particularly until the golfer becomes familiar with its operation.

A simpler prior art device actuates the legs with a rod which extends below the bottom of the bag, the rod is connected to the legs such that the legs automatically extend when the bag is positioned with the rod resting on the ground and then is urged downwardly. This device is shown in the form of an attachable stand in Jones, U.S. Pat. No. D 283,339, However, with the device shown in Jones '339, the rod must extend below the bottom of the bag in order to make it serve its intended use, and thus it prevents the bag from being placed upright on the ground or in a golf car on its base. This is not a serious problem with the attachable stand disclosed in Jones '339, since the stand can easily be removed if the bag is to be carried in a golf car. However, this problem is a serious impediment to incorporating this type of stand actuation mechanism integrally into a golf bag.

The subject invention permits incorporating the leg actuation system of Jones '339 integrally in a golf bag by relieving a portion of the base of the bag adjacent to the actuation rod, and making the rod terminate coplanar with the unrelieved portion of the base. The relieved portion is arranged such that when the bag is tilted to approximately the angle it will be at when the bag is supported on the legs, the end of the rod extends below the base and thus is exposed so that it can be moved when the bag is urged downwardly. Accordingly, the bag can be positioned vertically on the unrelieved portion of the base without interference with the actuation rod, and still have the actuation rod exposed so that it can be used to actuate the legs.

In a preferred embodiment of the invention, the base of the bag is flat. The unrelieved portion is oriented normal to the center line of the bag and the relieved portion is angled relative to the unrelieved portion at approximately the same angle that the bag will be offset from the vertical when it is supported by the legs. Thus, the relieved portion also provides a platform which makes the bag stable when it is supported by the legs.

Accordingly, it is a principal object of the present invention to provide a golf bag having integral legs which act in cooperation with the base of the bag to support it at an acute angle with respect to vertical.

It is a further object of the present invention to provide such a golf bag in which the legs are moved to an operative position where they support the bag merely by urging the bag downwardly.

It is a still further object of the present invention to provide such a golf bag in which the apparatus which is used to move the legs to their operative position does not prevent the golf bag from being supported vertically on its base.

It is a further object of the present invention to provide such a golf bag having a base with a relieved portion which is angled relative to the unrelieved portion at approximately the same angle the bag will be offset from the vertical when it is supported by the legs.

The foregoing and other objectives, features and advantages of the present invention will be more readily understood upon consideration of the following detailed description of the invention taken in conjunction with the accompanying drawings.

PREFERRED EMBODIMENT OF THE INVENTION

Figures 1, 2, 3:
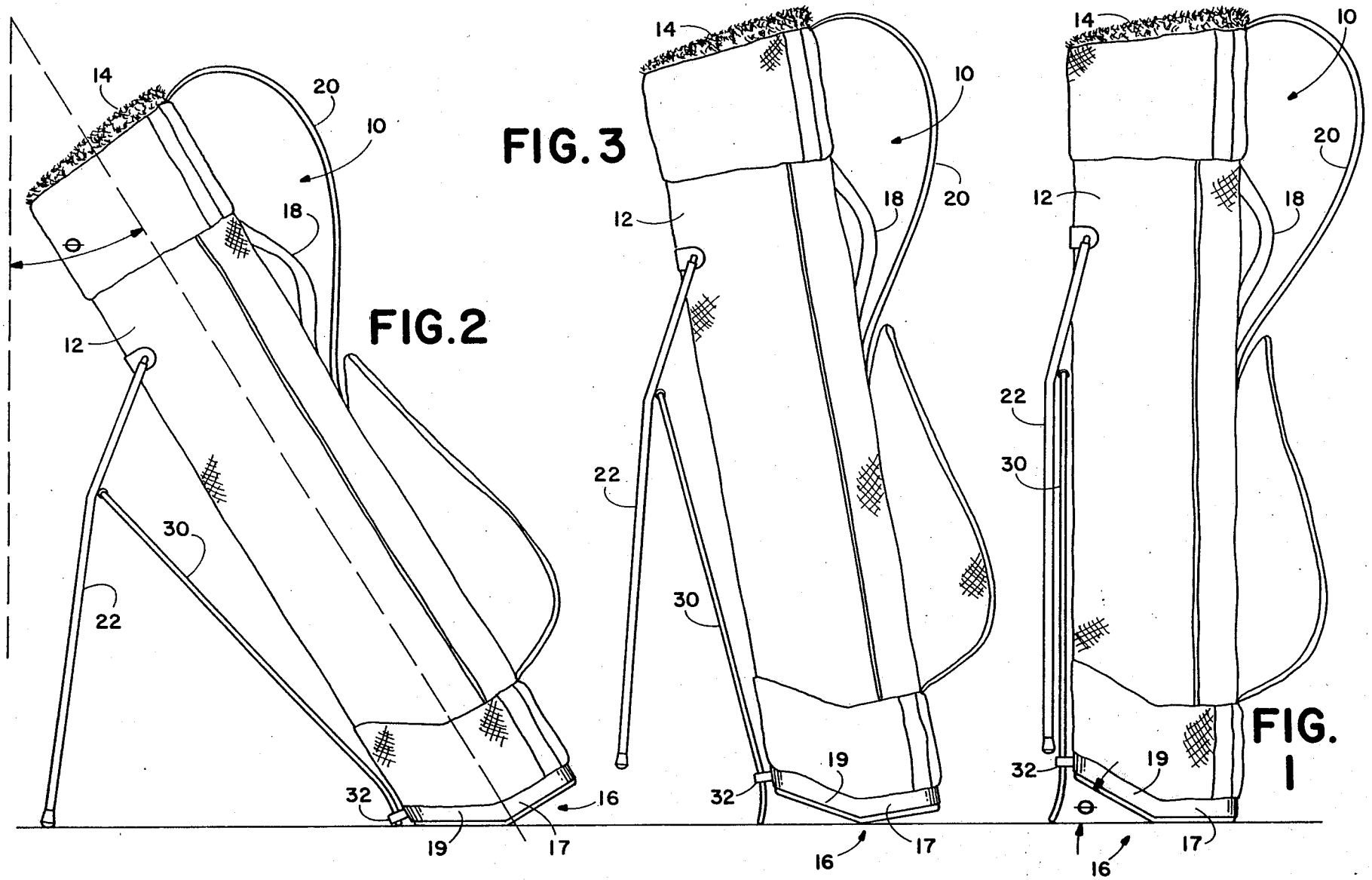
FIG. 1 is a side elevation view of a golf bag embodying the features of the present invention, shown with the legs retracted.
FIG. 2 is a side elevation view, of the golf bag if FIG. 1 shown with the legs fully extended.
FIG. 3 is a side elevation view of the golf bag of FIG. 1, shown with the legs partially extended.
Figure 4:
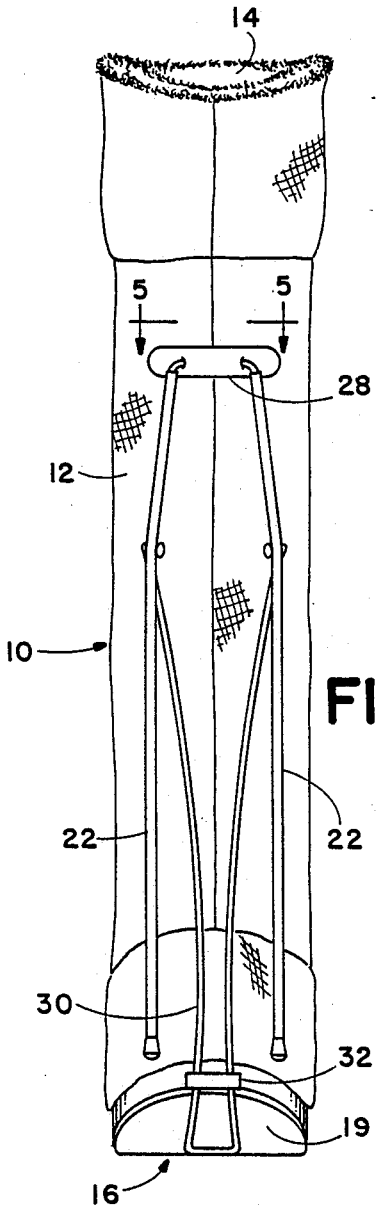
FIG. 4 is a rear view of the golf bag of FIG. 1.

Referring to the drawings, the golf bag 10 of the present invention comprises an elongate cylindrical shell 12 which is open at its upper end 14 to receive golf clubs (not shown) and is closed at its base 16. The shell can either be a unitary rigid sleeve or a rigid frame having a soft cover. Both types of construction are common and are well known in the golf bag industry. As is typical, the bag illustrated in the drawings has a handle 18 which allows the user to move or carry it with one hand, and a strap 20 which allows it to be carried over the user's shoulder. The base 16 has a first portion 17 which is perpendicular with the center line of the shell 12 and a second portion 19 which is angled outwardly from the first portion at a predetermined angle $\theta$. In a preferred embodiment $\theta$ equals approximately 30 degrees, and the base is divided approximately equally between its first and second portions.

Figure 5:
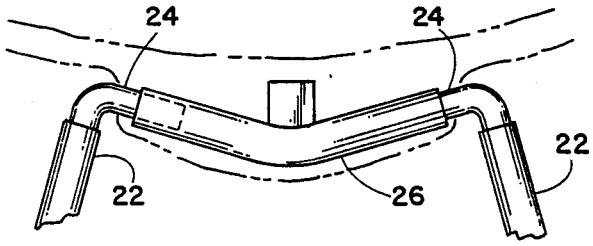
FIG. 5 is a fragmentary sectional view, partially broken and at an enlarged scale, taken along the line of 5—5 of FIG. 4.

Pivotally attached to the side of the shell 12, opposite the side which contains the handle 18 and strap 20, are a pair of legs 22. Referring to FIG. 5, in the embodiment illustrated in the drawings the pivot is formed by the extremities 24 of the legs being bent at 90 degrees with respect to the rest of the legs, and these extremities being rotatably journaled in the ends of a bent tube 26 that is affixed to the shell 12. A fabric patch 28 covers the tube 26 for sake of appearance. The pivot allows the legs 22 to be rotated between a retracted position, where they rest against the side of the shell, FIG. 1, and an extended position, where they are angled outwardly from the side of the shell, FIG. 2. Because the tube 26 is bent, the legs also move away from one another as they move to their extended position thereby providing more stability. The length of the legs and the location of the pivot of the shell is arranged such that the legs do not extend beyond the base of the bag when they are in their retracted position. When the legs are in their extended position they act in conjunction with the base 16 to support the bag with its center line being offset from the vertical by the same angle $\theta$ that the first and second base portions are separated from one another. The amount of the angle $\theta$ is such that the bag is sufficiently upright that clubs can easily be removed and inserted, and yet is steep enough that the bag is stable.

The legs are moved to their extended position by means of a U-shaped rod 30. The upper extremities of the rod 30 are pivotally attached to the legs 22 intermediate their ends. The lower closed end of the rod 30 fits slidably through a U-shaped bracket 32 which is attached to the shell immediately above the highest part of the second portion 19 of the base. When the rod 30 is pushed upwardly the legs 22 are moved to their extended position, and when the rod is pulled downwardly the legs are moved to the retracted position. When it is in the raised position the rod is angled with respect to the bag, which due to its interaction with the bracket 32, causes it to become bent. This bending creates a spring action which causes the rod to return to its lowered position unless it is kept in its raised position by the weight of the bag. Thus when the bag is lifted off of the ground the legs automatically return to their retracted position. The rod 30 is sized such that when the legs are in their retracted position its lower end is approximately coplanar with the first portion 17 of the base, and when the legs are in their extended position its lower end is just above the highest portion of the second portion 19 of the base.

In operation the legs 22 of the golf bag 10 of the subject invention are normally in their retracted position adjacent to the side of the bag. In this configuration the bag can be supported on the first portion 17 of the base with the shell 12 in a vertical orientation, FIG. 1. This position would be used, for example, when the base was momentarily set down when it was being transported, such as in the pro shop, or when the bag was placed in the bag rack of a golf car.

During play when the bag is being carried by a golfer or a caddy and it is set down to withdraw a club, the legs are moved to their extended position and the bag is supported on the second portion 19 of the base and the legs 22. In this position the bag is much more stable than it is in the vertical position. This is accomplished by tilting the bag until the second portion 19 of the base is approximately parallel with the ground and the bottom of the rod 30 is in contact with the ground. The bag then is pushed downwardly until the second portion of the base is in contact with the ground, thereby extending the legs 22 so that the bag is supported cooperatively by the base and the legs.

By having the second portion 19 of the base angled with respect to the first portion, the rod does not have to extend below the first portion of the base, thereby permitting the bag to be placed in an upright position on the first portion of the base. However, the angled second portion of the base allows the actuation rod to be exposed when the bag is tilted and thus permits the actuation rod to be moved to extend the legs.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In a golf bag of the type having an elongate cylindrical shell which is open at its upper end to receive golf clubs and is enclosed at its base to support clubs therein, the improvement comprising:

(a) legs associated with the shell;

(b) means for permitting said legs to be moved between a retracted position in adjacency with said shell and an extended postion where said legs act in cooperation with the base to support the shell at a predetermined acute angle with respect to the vertical;

(c) actuation means for moving said legs to their extended positon when said actuation means is positoned against the ground and the shell is urged downwardly;

(d) a portion of said base being relieved to permit downward movement of the shell when said actuation means is in contact with the ground and the shell is oriented at or near said predetermined acute angle, without said actuation means being in contact with the ground when said shell is vertical and the remainder of said base is resting on the ground; and (e) the remainder of said base being planar and oriented substantially normal to the elongate axis of said shell so that said shell will be vertical when the remainder of said base is resting on the ground, and said relieved portion being planar and oriented at approximately said predetermined actue angle with respect to the remainder thereof.

2. The golf bag of claim 1 wherein said legs are attached pivotally to said shell and said acutation means comprises a rod having a first end which is pivotally attached to said legs intermediate the ends thereof, and a second end which is slidably and rotatably secured to said shell proximate said base.

3. The golf bag of claim 1 wherein said relieved portion comprises approximately one-half of said base.

4. The golf bag of claim 1 wherein said second end of said rod terminates at a point which is approximately coplanar with the remainder of said base when said legs are in their retracted position, and terminates approximately at the uppermost portion of said relieved portion when said legs are in their extended position.

* * * * *

UNITED STATES PATENT AND TRADEMARK OFFICE

CERTIFICATE OF CORRECTION

PATENT NO. : 4,921,192

DATED : May 1, 1990

INVENTOR(S) : George H. Jones

It is certified that error appears in the above-identified patent and that said Letters Patent is hereby corrected as shown below:

In the Abstract:

| | |
|---|---|
| Line 11 | Change "rodo" to --rod-- |
| Col. 2, line 39 | After "broken" insert --away-- |
| Col. 4, line 27 | Change "postion" to --position-- |
| Col. 4, line 33 | Change "positoned" to --positioned-- |

Signed and Sealed this

Tenth Day of September, 1991

*Attest:*

*Attesting Officer*

HARRY F. MANBECK, JR.

*Commissioner of Patents and Trademarks*